US010299319B2

(12) United States Patent
Hall et al.

(10) Patent No.: US 10,299,319 B2
(45) Date of Patent: May 21, 2019

(54) ZERO-RESONANCE MICROWAVE OVEN

(71) Applicants: David R. Hall, Provo, UT (US); Andrew Priddis, Mapleton, UT (US); Matthew Liddle, Orem, UT (US); Jedediah Knight, Provo, UT (US)

(72) Inventors: David R. Hall, Provo, UT (US); Andrew Priddis, Mapleton, UT (US); Matthew Liddle, Orem, UT (US); Jedediah Knight, Provo, UT (US)

(73) Assignee: Hall Labs LLC, Provo, UT (US)

( * ) Notice: Subject to any disclaimer, the term of this patent is extended or adjusted under 35 U.S.C. 154(b) by 16 days.

(21) Appl. No.: 15/375,831

(22) Filed: Dec. 12, 2016

(65) Prior Publication Data

US 2018/0168007 A1 Jun. 14, 2018

(51) Int. Cl.
*H05B 6/64* (2006.01)
*H05B 6/80* (2006.01)

(52) U.S. Cl.
CPC ..... *H05B 6/642* (2013.01); *H05B 6/6402* (2013.01)

(58) Field of Classification Search
CPC ..... H05B 6/64–3402; H05B 6/80–808
USPC ..... 219/678, 687, 688, 756–757, 759, 219/770–773
See application file for complete search history.

(56) References Cited

U.S. PATENT DOCUMENTS 4,137,441 A * 1/1979 Bucksbaum ..... H05B 6/763 219/742
5,387,780 A * 2/1995 Riley ..... H05B 6/70 219/688
6,018,157 A * 1/2000 Craft ..... H05B 6/6408 219/686
6,329,645 B2 * 12/2001 Giberson ..... G01N 1/44 219/694
6,797,928 B2 * 9/2004 Giberson ..... H05B 6/806 219/679
2004/0206755 A1 * 10/2004 Hadinger ..... H05B 6/80 219/761
2006/0006172 A1 * 1/2006 Sedlmayr ..... B01D 1/0017 219/688
2006/0039838 A1 * 2/2006 Barnhardt ..... B01J 19/0013 422/186
2006/0191913 A1 * 8/2006 Park ..... A47J 31/0573 219/679

(Continued)

OTHER PUBLICATIONS

Yuichi Kudo and Hiroshi Inoue, Relative Dielectric Constant Characteristics of Liquid at VHF Band Using Small Cell Impedance Analysis, 1998, Akita University Graduate School of Mining and Engineering.*

*Primary Examiner* — Michael A Laflame, Jr.

(57) ABSTRACT

Embodiments of the zero-resonance microwave oven are described herein that include a cooking cavity, an opening that allows access to the cavity, one or more microwave-transparent walls surrounding the cavity, a microwave-opaque housing also surrounding the cavity, and a reservoir disposed between the microwave-transparent walls and the microwave-opaque housing. The reservoir is filled with a dielectric material, and has a depth greater than or equal to half the penetration depth of microwaves in the dielectric material and less than or equal to twice the penetration depth of microwaves in the dielectric material. Other embodiments of the zero-resonance microwave oven are also described herein.

20 Claims, 14 Drawing Sheets

(56) References Cited

U.S. PATENT DOCUMENTS

| | | | | |
|---|---|---|---|---|
| 2009/0134152 | A1* | 5/2009 | Sedlmayr | H05B 6/806 219/687 |
| 2010/0051612 | A1* | 3/2010 | Fagrell | B01J 19/126 219/748 |
| 2012/0298655 | A1* | 11/2012 | Kamii | F24C 15/14 219/688 |

* cited by examiner

ZERO-RESONANCE MICROWAVE OVEN

TECHNICAL FIELD

This invention relates generally to microwave ovens.

BACKGROUND

The modern microwave oven, for all its apparent sophistication, has stagnated in development over the past decade. One particular problem that has yet to be sufficiently addressed is uneven cooking. This arises due to zones of constructive and destructive microwave interference. One solution commonly used has been to place the object being cooked on a rotating plate that moves the object through various zones of constructive interference. Another solution has been to place a "stirrer" at the opening of the waveguide to alter the direction of the microwaves as they enter the cooking cavity. While these solutions are helpful, they still allow for some uneven cooking. This is particularly problematic for cooking foods, such as meat, in a microwave oven, because undercooked food can make a person ill, and overcooked food can be unpalatable. Thus, there is room for improvement of microwave ovens.

SUMMARY OF THE INVENTION

Described herein are embodiments of a microwave oven that addresses at least some of the issues described above. In general, the microwave oven includes a zero-resonance cooking cavity. The zero-resonance cooking cavity ensures no constructive or destructive interference caused by reflections within the cooking cavity. This ensures more uniform power distribution throughout the cavity, and, thus, uniform cooking.

One embodiment of the zero-resonance microwave oven described herein includes a cooking cavity, an opening that allows access to the cavity, one or more microwave-transparent walls surrounding the cavity, a microwave-opaque housing also surrounding the cavity, and a reservoir disposed between the microwave-transparent walls and the microwave-opaque housing. The reservoir is filled with a dielectric material, and has a depth greater than or equal to half the penetration depth of microwaves in the dielectric material and less than or equal to twice the penetration depth of microwaves in the dielectric material. Other embodiments of the zero-resonance microwave oven are also described herein.

BRIEF DESCRIPTION OF THE DRAWINGS

A more particular description of the invention briefly described above is made below by reference to specific embodiments. Several embodiments are depicted in drawings included with this application, in which.

DETAILED DESCRIPTION

A detailed description of the claimed invention is provided below by example, with reference to embodiments in the appended figures. Those of skill in the art recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The descriptions of the various embodiments include, in some cases, references to elements described with regard to other embodiments. Such references are provided for convenience to the reader, and to provide efficient description and enablement of each embodiment, and are not intended to limit the elements incorporated from other embodiments to only the features described regarding the other embodiments. Rather, each embodiment is distinct from each other embodiment. Despite this, the described embodiments do not form an exhaustive list of all potential embodiments of the apparatus described herein; various combinations of the described embodiments are also envisioned, and are inherent from the descriptions of the embodiments below. Additionally, embodiments not described below that meet the limitations of the claimed invention are also envisioned, as is recognized by those of skill in the art.

In some instances, features represented by numerical values, such as dimensions, quantities, and other properties that can be represented numerically, are stated as approximations. Unless otherwise stated, an approximate value means "correct to within 50% of the stated value." Thus, a length of approximately 1 inch should be read "1 inch+/−0.5 inch." Similarly, other values not presented as approximations have tolerances around the stated values understood by those skilled in the art. For example, a range of 1-10 should be read "1 to 10 with standard tolerances below 1 and above 10 known and/or understood in the art."

Figure 1:
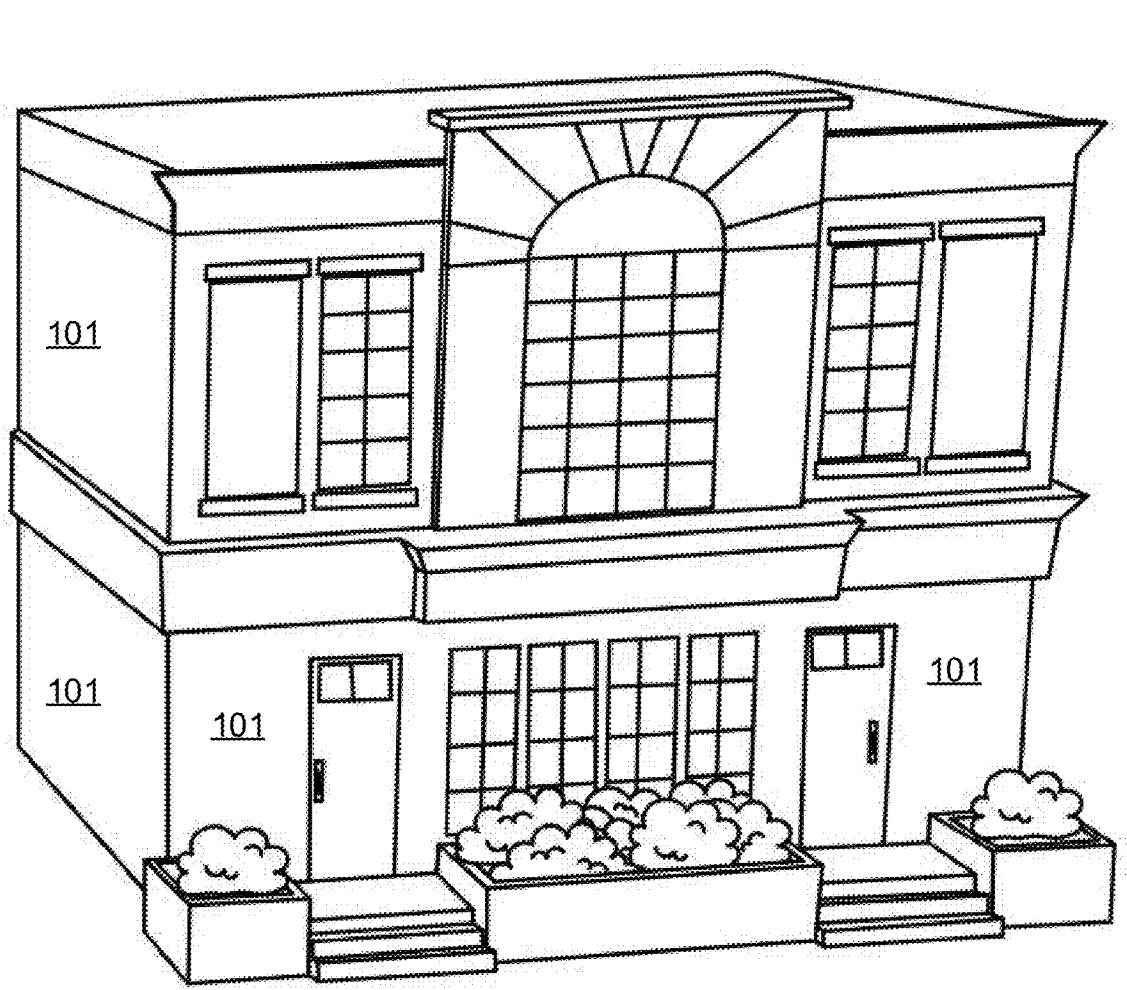
FIG. 1 depicts a perspective view of a modern building structure that necessitates novel appliance designs.

FIGS. 1-4D depict various aspects of a modern building having unique construction aspects that necessitate the improvements to the microwave oven described herein. FIG. 1 depicts a perspective view of one embodiment of such a building, structure 100. As shown, the outer finish of structure 100 is, in some embodiments, a facade with any variety of architectural embellishments. Inside outer walls 101, though unseen, is a building infrastructure comprising a plurality of conjoining modular building segments.

Figure 2:
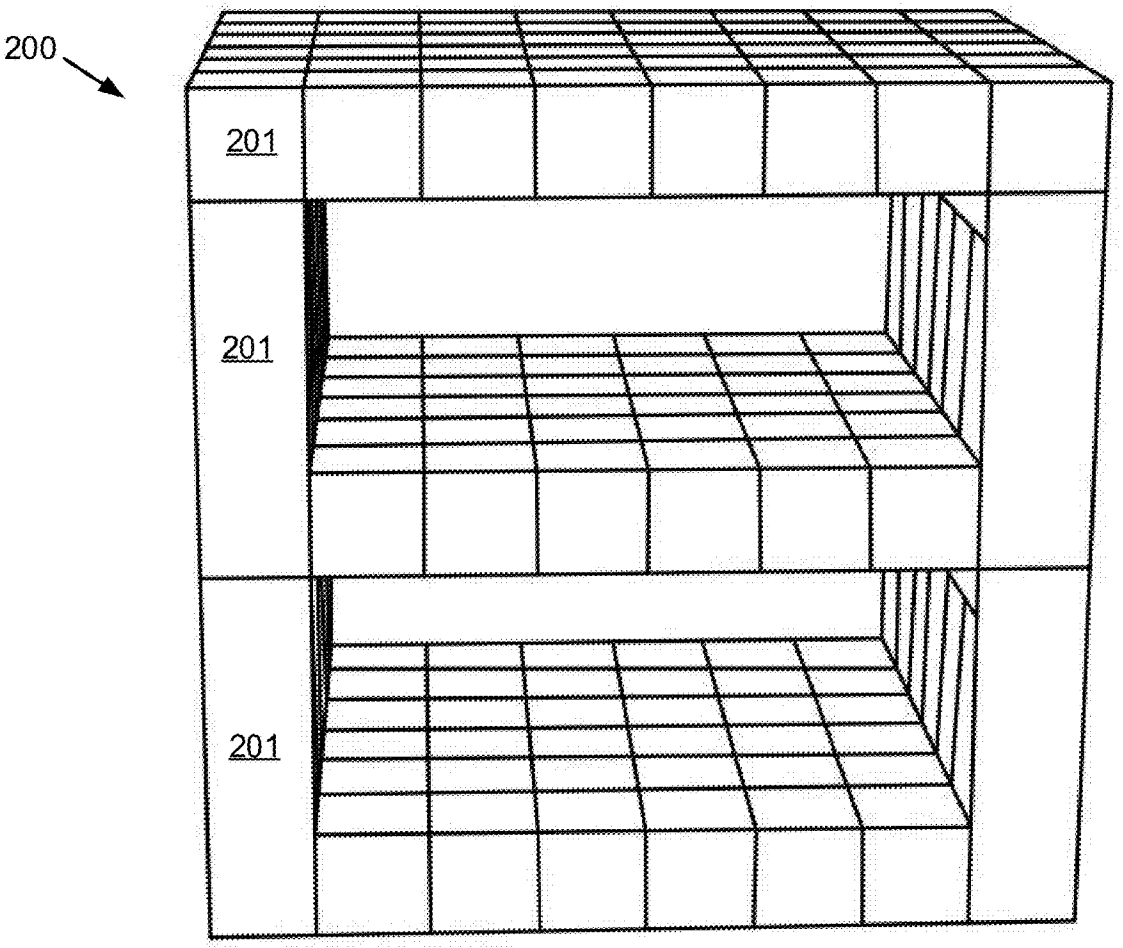
FIG. 2 depicts a modern building infrastructure.

FIG. 2 depicts building infrastructure 200, which comprises a plurality of conjoining modular building segments 201. As shown, the plurality of conjoining modular building segments are prismatic, box-like structures.

Figure 3:
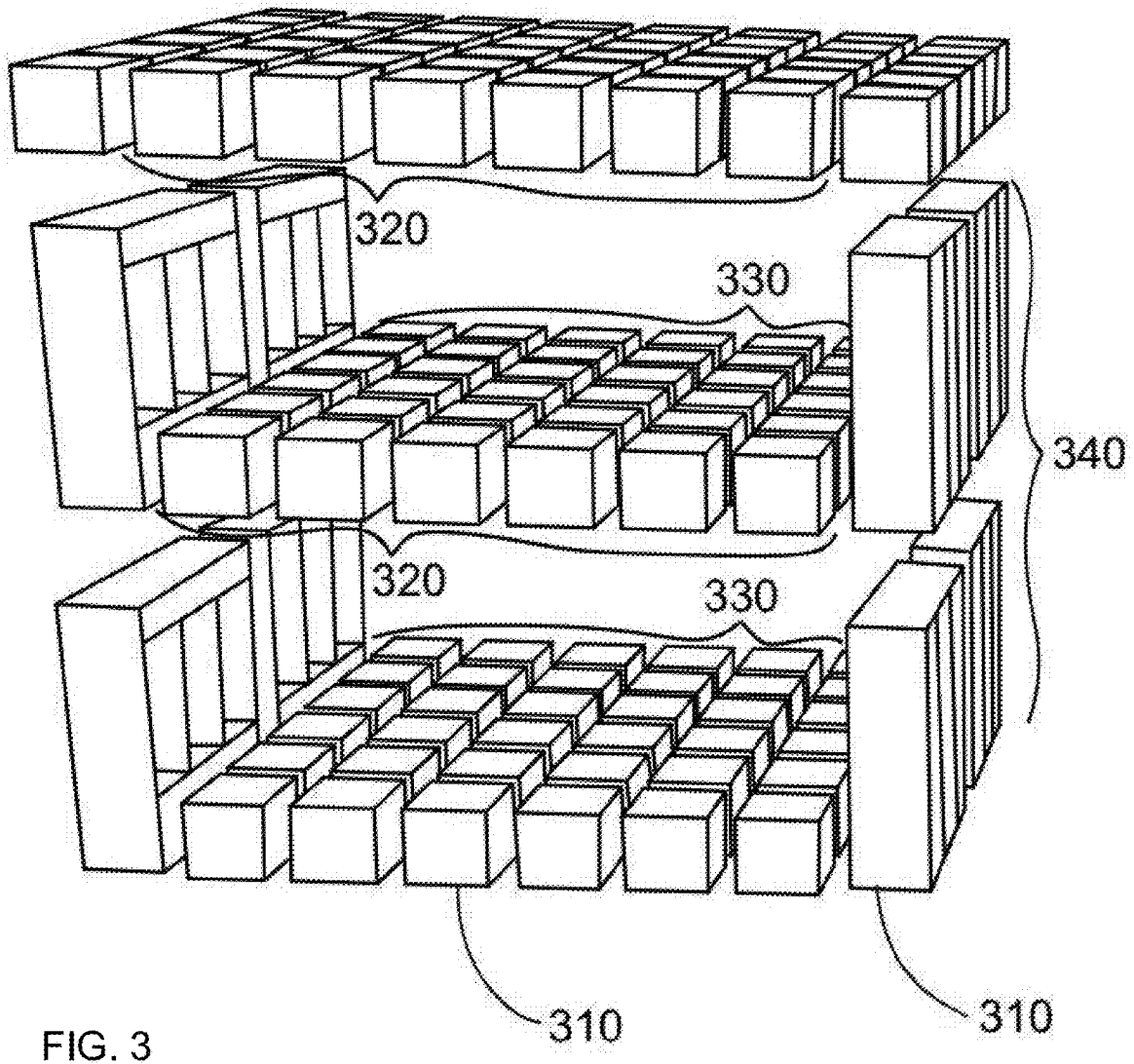
FIG. 3 depicts an exploded view of a modern building infrastructure.

FIG. 3 depicts an exploded view of a building infrastructure, similar to that depicted in FIG. 2, such that each individual prismatic box-like structure is visible. Building infrastructure 300 includes prismatic structures 310; a first selection 320 of the plurality of prismatic box-like structures, placed side by side horizontally and mechanically attached to form a length and width of at least one ceiling; a second selection 330 of the plurality of conjoining modular building segments are placed side by side horizontally and mechanically attached to form a length and width of at least one floor; and a third selection 340 of the plurality of conjoining modular building segments are placed side by side vertically and mechanically attached to each other and to at least one ceiling and at least one floor to form a plurality of walls for the building infrastructure.

FIGS. 4A-D depict perspective views of different embodiments of the prismatic box-like structures. The prismatic box-like structures may comprise different shapes, including shapes like cubic 4A, rectangular 4B, triangular 4C, and hexagonal 4D. Each prismatic box-like structure comprises at least three walls 400. Each prismatic box-like structure comprises an apparatus suitable for disposition of a stored item. A space 410 inside the walls measures at least one cubic foot in order that items can be stored within the prismatic box-like structures, thus maximizing space, efficiency, sustainability, and structural integrity of the building infrastructure.

Figure 4D:
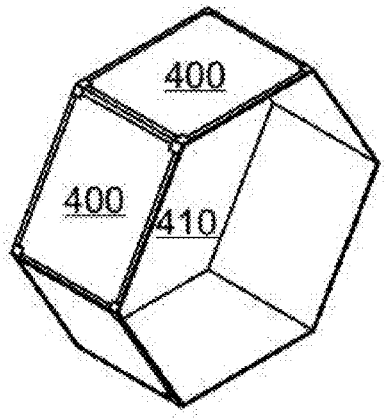
FIGS. 4A-D depict perspective views of different embodiments of the prismatic box-like structures.
Figure 4A:
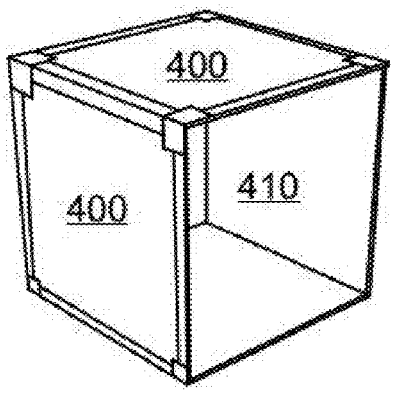
Figure 4C:
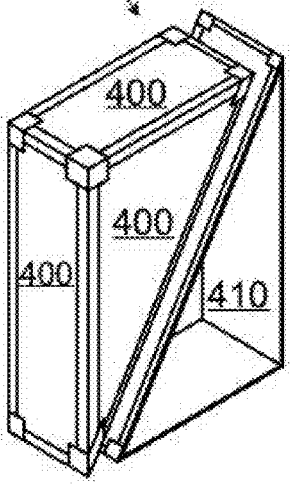
Figure 4B:
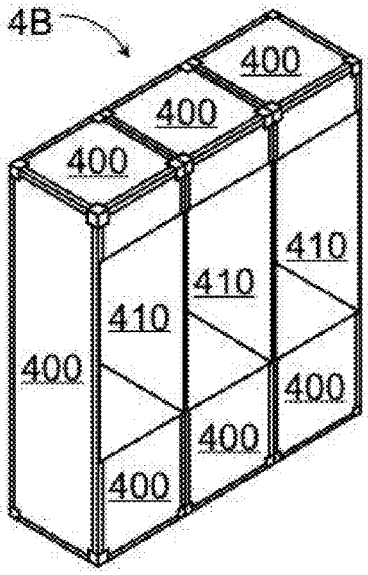

FIG. 4B depicts one unique structural arrangement in which the microwave oven of the claimed invention is, in various embodiments, particularly useful. As described above, the size of the prismatic structures is particularly chosen for efficiency, structural integrity. Power provisioning is likewise chosen to maximize these characteristics. Many current appliances, while individually compatible with the described infrastructure, are not collectively compatible, such as because of size and power requirements, among other reasons. Thus, new appliance designs are needed. The claimed microwave oven is one such appliance compatible with the unique building infrastructure described above.

In general, embodiments of a zero-resonance microwave oven are described herein that include a cooking cavity, an opening that allows access to the cavity, one or more microwave-transparent walls surrounding the cavity, a microwave-opaque housing also surrounding the cavity, and a reservoir disposed between the microwave-transparent walls and the microwave-opaque housing. The reservoir is filled with a dielectric material, and, in various embodiments, has a depth greater than or equal to half the penetration depth of microwaves in the dielectric material and/or less than or equal to twice the penetration depth of microwaves in the dielectric material. In various embodiments, the dielectric material includes water, ester, betaine, glycerol, methanol, propylene glycol, ethanol, or combinations thereof. In some embodiments that include water, the water includes deionized water, heavy water, or combinations thereof.

Various embodiments of the zero-resonance microwave oven are constructed in various shapes. For example, in one some embodiments, the cavity is cylindrical, polyhedral, hexahedral, cubic, rectangularly cuboid, or combinations thereof. In the same or other embodiments, at least one of the microwave-transparent walls and the opening, or the microwave-opaque housing, form a shape comprising a cylinder, a polyhedron, a hexahedron, a cube, a rectangular cuboid, or combinations thereof. Additionally, in various embodiments, the microwave oven includes one or more intersections whereat the microwave-transparent walls merge with the microwave-transparent housing.

Embodiments of the microwave oven described herein also include a door disposed over the opening. In at least some such embodiments, the door includes a microwave-transparent inner wall facing the cavity and a microwave-opaque outer wall. Various of such embodiments include a second reservoir filled with a second dielectric material and disposed between the microwave-transparent inner wall and the microwave-opaque outer wall. The second reservoir has a depth greater than or equal to half the penetration depth of microwaves in the second dielectric material and less than or equal to twice the penetration depth of microwaves in the second dielectric material. Some embodiments include a passage between the second reservoir and the first reservoir (i.e. the reservoir that is disposed between the one or more microwave-transparent walls and the microwave-opaque housing). Additionally, similar to the dielectric material in the first reservoir, in various embodiments, the second dielectric material includes water, ester, betaine, glycerol, methanol, propylene glycol, ethanol, or combinations thereof. Various of the embodiments including water include deionized water, heavy water, or combinations thereof.

Some embodiments of the zero-resonance microwave oven described herein include a cooling coil disposed outside the microwave-opaque housing and coupled to the reservoir. For example, in some embodiments, at least a portion of the cooling coil is disposed above the reservoir. Some embodiments having the cooling coil include a constrictor valve and a liquid reintroduction valve, each coupled to the reservoir through the microwave-opaque housing.

Some embodiments include additional or other means of cooling the dielectric fluid within the first and/or second reservoirs. For example, in some embodiments, one or more steam vents are disposed above the reservoir, such as through the microwave-opaque housing. Some embodiments, especially those where the dielectric material is a fluid, include a fluid supply hose coupled to the reservoir. Some such embodiments include a check valve directly coupling the fluid supply hose to the reservoir. For example, in some such embodiments, the pressure of fluid in the fluid supply hose is equal to the counter-pressure of fluid in the reservoir and, as fluid in the reservoir evaporates, the counter-pressure decreases, thereby allowing fluid to flow from the fluid supply hose into the reservoir. Additionally, in various embodiments where the dielectric material is a fluid, the microwave oven further comprises a fluid stirrer disposed within the reservoir.

Figure 5A:
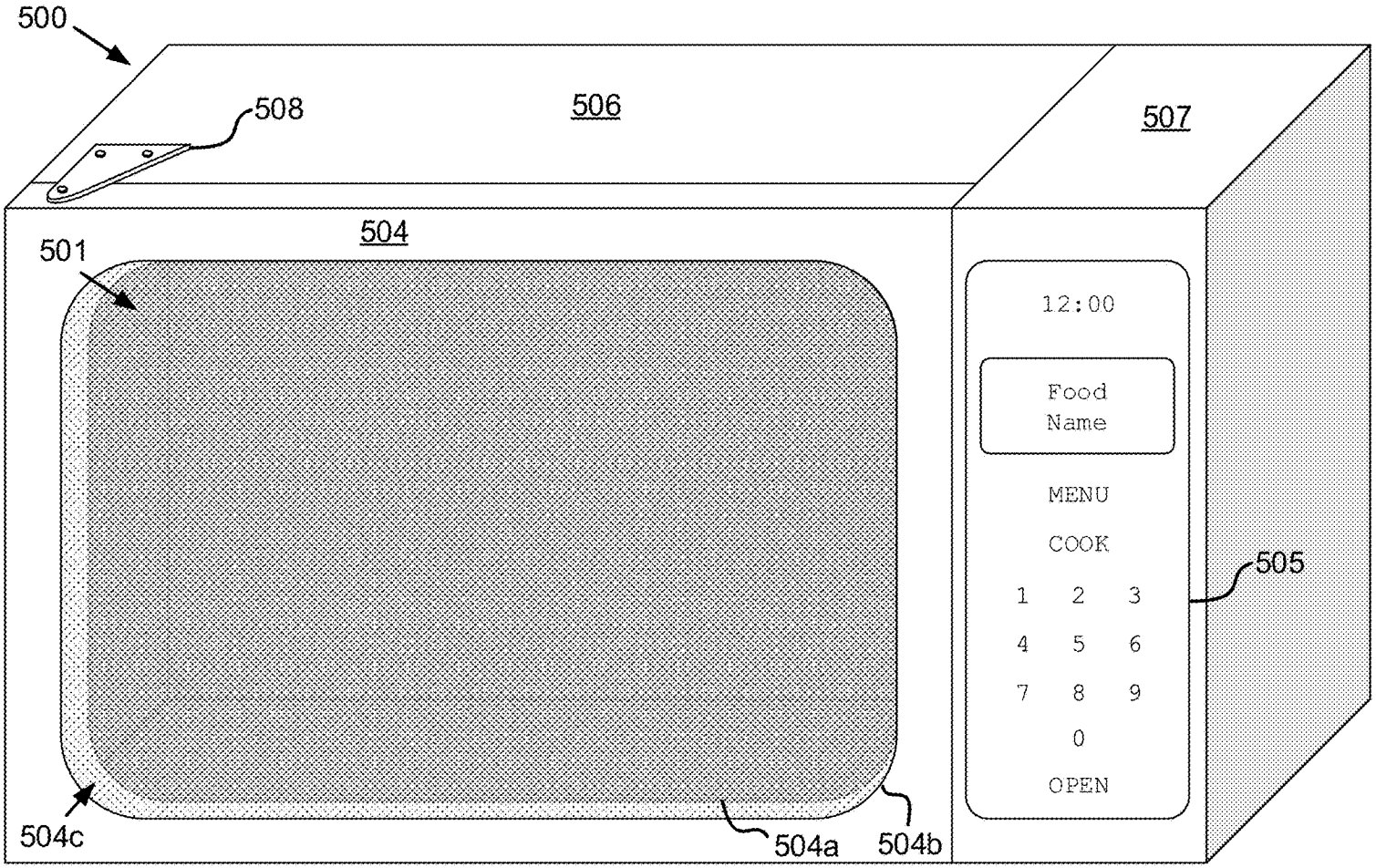
FIGS. 5A-C depict three embodiments of a zero-resonance microwave oven.
Figure 5B:
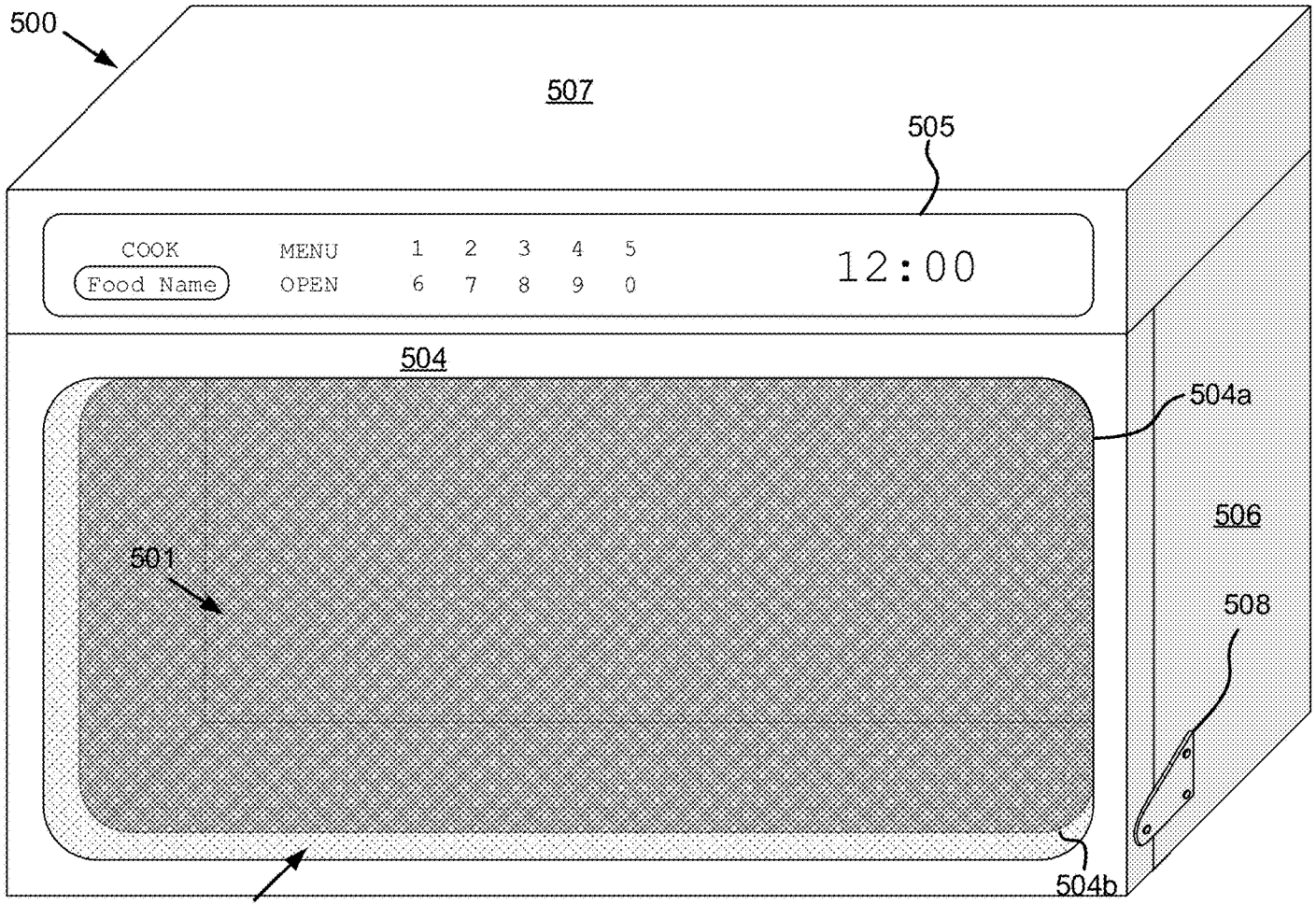
Figure 5C:
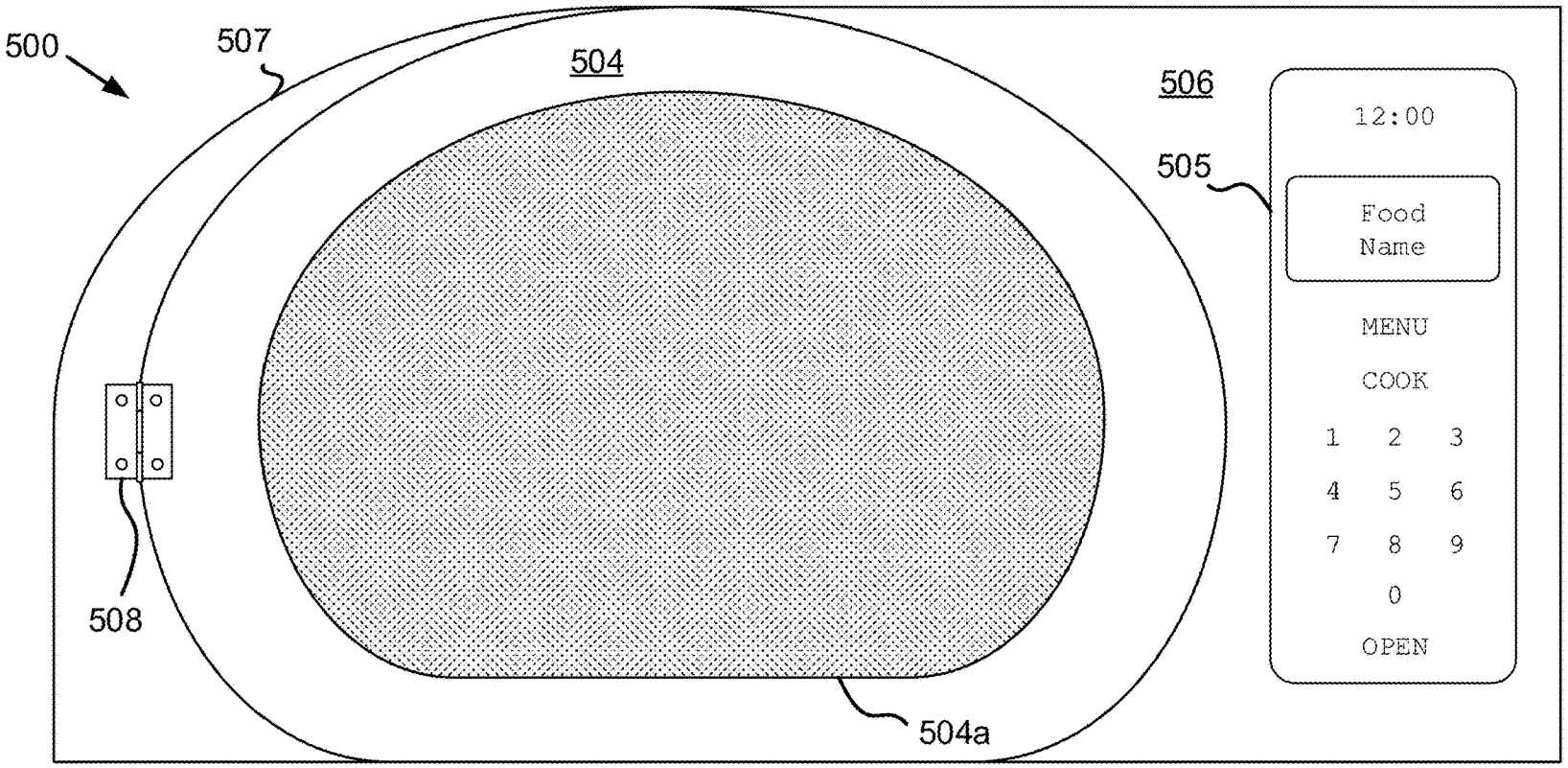

FIGS. 5A-C depict three embodiments of a zero-resonance microwave oven. Microwave oven 500 includes cooking cavity 501, door 504, control panel 505, housing 506, and electronics compartment 507. Within the housing, and forming the cooking cavity, are microwave-transparent walls. Additionally, a reservoir of dielectric material is disposed between the housing and the microwave-transparent walls. The housing, microwave-transparent walls, reservoir, and dielectric material are described below in more detail regarding FIGS. 6-8. Within the electronics compartment and behind the control panel is an electronics compartment that houses various electronic components of the microwave oven, including a magnetron, a power transformer, a rectifier, a cooling fan, and a controller.

As depicted, the door includes interior wall 504*a*, exterior wall 504*b*, and reservoir 504*c* disposed between the interior wall and the exterior wall. A dielectric material fills the reservoir. The interior and exterior walls, reservoir, and dielectric material are similar to features described below regarding FIGS. 6-8, and are described in more detail therewith. The door is, in various embodiments, secured by a detent or an electromagnet. For example, in the depicted embodiment, the door is electromagnetically latched closed. A permanent magnet is installed in the door, and a corresponding electromagnet and/or weak permanent magnet are installed in the body of microwave oven 500. When a user presses the "OPEN" button on the control panel, the direction of the current running through the electromagnet is switched momentarily (for up to 2-3 seconds in some cases), reversing the direction of the magnetic field generated by the electromagnet. The reverse magnetic field is stronger than the force generated by the magnetic fields of the permanent magnets in the door and the body, and forces the door open.

The control panel is, generally, an interface that allows the user to interact with processors and memory that control operation of the microwave oven. In some embodiments, the control panel is a graphical user interface displayed on a touchscreen. In other embodiments, the control panel includes push buttons. In yet other embodiments, the control panel includes permanent markings on or over a touchscreen. The hardware processors and memory store instructions for operating the microwave oven. In various embodiments, those instructions include identifying a power level either desired or necessary, identifying an amount of time needed for cooking, and delivering power to the magnetron via the transformer. In some embodiments, some or all of these steps are automated. For example, in one embodiment, the microwave oven includes one or more diodes facing into the cooking cavity. The processors use the diodes to determine whether the cooking cavity contains an object or objects to be heated and powers the magnetron accordingly.

As shown in the depicted embodiments, various embodiments of the zero-resonance microwave oven include hinge 508 that couples the door to the housing. The hinge is, in various embodiments, an external hinge, which enhances the zero-resonance effect of the microwave oven.

FIG. 5A depicts an embodiment of the zero-resonance microwave oven where the cooking cavity and the electronics compartment are horizontally adjacent. FIG. 5B depicts and embodiment of the zero-resonance microwave oven where the cooking cavity and the electronics compartment are vertically adjacent. FIG. 5C depicts an embodiment of the zero-resonance microwave oven where the cooking cavity and the electronics compartment are horizontally adjacent, and where the housing is cylindrically-shaped. One benefit of such a structure is enhancement of the zero-resonance effect of the microwave oven for shallower reservoirs. This occurs because average path lengths for microwaves striking the microwave-opaque housing is longer because the path of the reservoir is always curved towards the path of a reflected microwave, except for perpendicular waves.

Figure 6:
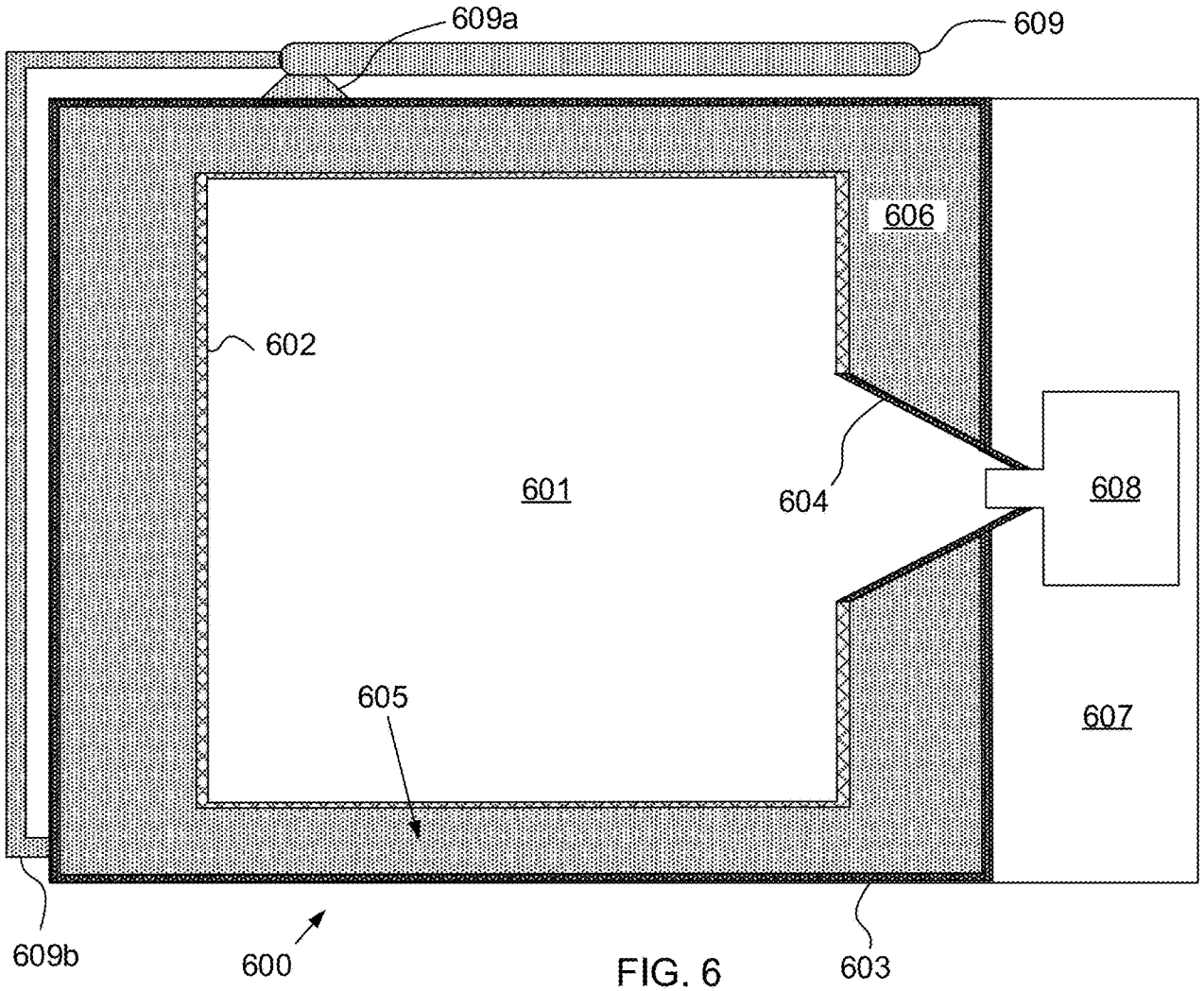
FIG. 6 is a section view of one embodiment of a zero-resonance microwave, including selected components.

FIG. 6 is a section view of one embodiment of a zero-resonance microwave, including selected components. Microwave oven 600 includes cooking cavity 601, microwave-transparent walls 602, microwave-opaque housing 603, waveguide 604, reservoir 605, dielectric material 606, electronics compartment 607, magnetron 608, and cooling coils 609.

The cooking cavity, as shown, is cubic in shape. However, in various other embodiments, the cooking cavity is cylindrical, polyhedral, hexahedral, rectangularly cuboid, or combinations thereof. For example, in some embodiments, such as those similar to the embodiment depicted in FIG. 5B where the cooking cavity is disposed beneath the electronics compartment, the cooking cavity is triangularly cuboid or pyramidical. In some such embodiments, the waveguide is disposed over the cooking cavity. In other embodiments, such as those similar to the embodiment depicted in FIG. 5C, the cooking cavity is cylindrical or spherical in shape. In some embodiments with irregularly-shaped cooking cavities, a microwave-transparent support surface is provided that allows the item being cooked to be supported in an appropriate orientation for that item.

The microwave-transparent walls surround the cooking cavity and help form the reservoir. Thus, the microwave-transparent walls are formed of any of a variety of materials that are sturdy and transparent to microwaves. In some embodiments, the microwave-transparent walls are formed of glass. In other embodiments, the microwave-transparent walls are formed of a rigid, thermally-resistant plastic. In some embodiments, the microwave-transparent walls are formed of a flexible plastic that is supported by microwave-transparent and rigid arms coupled to the microwave-opaque housing and/or other portions of the microwave-transparent walls. In various embodiments, the microwave-transparent walls are supported by direct and/or indirect coupling to the microwave-opaque housing (such as that depicted in FIG. 11), by the dielectric material disposed within the reservoir, or combinations thereof.

The microwave-opaque housing surrounds the cooking cavity outside the microwave-transparent walls, and reflects microwaves emanating through the dielectric material back into the dielectric material. In some embodiments, the microwave-opaque housing provides structural support for various components of the microwave oven. Thus, in some embodiments, the microwave-opaque housing is formed of a metal, such as steel and/or aluminum. Additionally, although in the depicted embodiment, the microwave-opaque housing is the outer-most surface of the microwave (besides the cooling coils), in various embodiments, additional housing is provided around the microwave-opaque housing.

The waveguide directs microwave emitted by the magnetron into the cavity. As shown, in some embodiments, the waveguide is short. However, depending on the desired positioning of the waveguide and the magnetron, the waveguide has a variety of shapes and lengths. Additionally, as shown, the waveguide is made of a reflective material in various embodiments.

The reservoir is disposed between the microwave-transparent walls and the microwave-opaque housing, and holds the dielectric material. Generally, the reservoir has a depth greater than or equal to half the penetration depth of microwaves in the dielectric material. However, in some embodiments, the depth of the reservoir between the microwave-transparent walls and the microwave-opaque housing is, at its least, based on the shortest path length that any microwaves traveling through the reservoir would take and still be completely, or almost completely, attenuated in the dielectric material. For example, in areas of the microwave oven where microwaves pass perpendicularly through the microwave-transparent walls, the reservoir has a depth of at least one half the penetration depth of microwaves in the dielectric material. However, in areas of the microwave oven where microwaves pass through the microwave-transparent walls at an angle less than ninety degrees, the depth of the reservoir falls off proportionally with the sine of the angle the path of the microwaves form with the surface of the microwave-transparent walls. The various depths described are according to various embodiments of the claimed invention.

The dielectric material generally includes any material that attenuates the power of microwaves travelling through the material. While some dielectric materials perform better than others, attenuation of microwaves is generally linear, and is proportional to the material's dielectric constant. Thus, in some embodiments where it is desirable to have a smaller reservoir, a material having a high dielectric constant is used. In some embodiments where it is desirable to have a larger reservoir, a material having a lower dielectric constant may be used. Similarly, in embodiments where a certain dielectric material is desirable, the depth of the reservoir may be chosen based on the penetration depth of microwaves in the desirable dielectric material.

Various embodiments include various types of dielectric materials. In some embodiments, the dielectric material is a solid and/or solid porous material. In some embodiments, the dielectric material is a fluid, such as a gel and/or liquid. For example, some embodiments include water, ester, betaine, glycerol, methanol, propylene glycol, ethanol, or combinations thereof. In some embodiments that include water, the water includes deionized water, heavy water, or combinations thereof. Some embodiments include combinations of solid and fluid dielectrics. Because the dielectric material absorbs the energy of the microwaves, various embodiments of the zero-resonance microwave include means for cooling the dielectric material. For example, in some embodiments that include a solid dielectric material, a fluid dielectric is also incorporated. The fluid, in various such embodiments, circulates over and/or through the solid dielectric to carry away some of the kinetic energy generated in the solid dielectric by the microwaves. In some embodiments that include a fluid dielectric material, the fluid is cooled by any of a variety of means, a few examples of which are described below regarding this FIG. and FIGS. 7 and 10A-C.

The magnetron includes a variety of features, including features such as an anode and cathode, at least one magnet, cooling vanes, and an antenna. Other magnetrons that emit microwaves, but have other structures and/or components, are also envisioned. The magnetron emits microwaves generated by the magnetron into the cooking cavity. In various embodiments, the magnetron is mounted to the microwave-opaque housing. However, in some embodiments, the magnetron is mounted to a wall surrounding the electronics compartment, either in addition to or instead of mounting to the microwave-opaque housing. Though not depicted, as described above, the electronics compartment, in addition to housing the magnetron, houses various other electronics components in various embodiments.

As depicted, in some embodiments, the cooling coils are disposed above the microwave oven outside the housing. In some embodiments, the cooling coils are housed within a second housing that encompasses the microwave-transparent housing and surrounds and/or forms the electronics compartment. Additionally, in some embodiments, a fan is disposed near the cooling coils to blow or draw air across the cooling coils. The cooling coils are coupled through the microwave-opaque housing to the reservoir, in the depicted embodiment, by constrictor valve 609*a* and fluid reintroduction valve 609*b*. One embodiment of the constrictor valve is described more below regarding FIG. 10C, but, generally, the constrictor valve allows fluid to pass from the reservoir into the cooling coils. In some embodiments, this is accomplished by pumping, whereas in other embodiments this occurs passively, such as through evaporation. As the fluid passes through the coils, it is cooled by high surface-area-to-volume ratio contact with cooler air outside the microwave oven via the coils. The fluid reintroduction valve passes fluid from the cooling coils back into the reservoir.

In some embodiments, the fluid in the cooling coil is separate from the dielectric material in the reservoir. For example, in some embodiments, the cooling coils are fluidically coupled to a condenser and a thermal evaporation valve, and fluid is circulated through the cooling coils separately from the reservoir.

Figure 7:
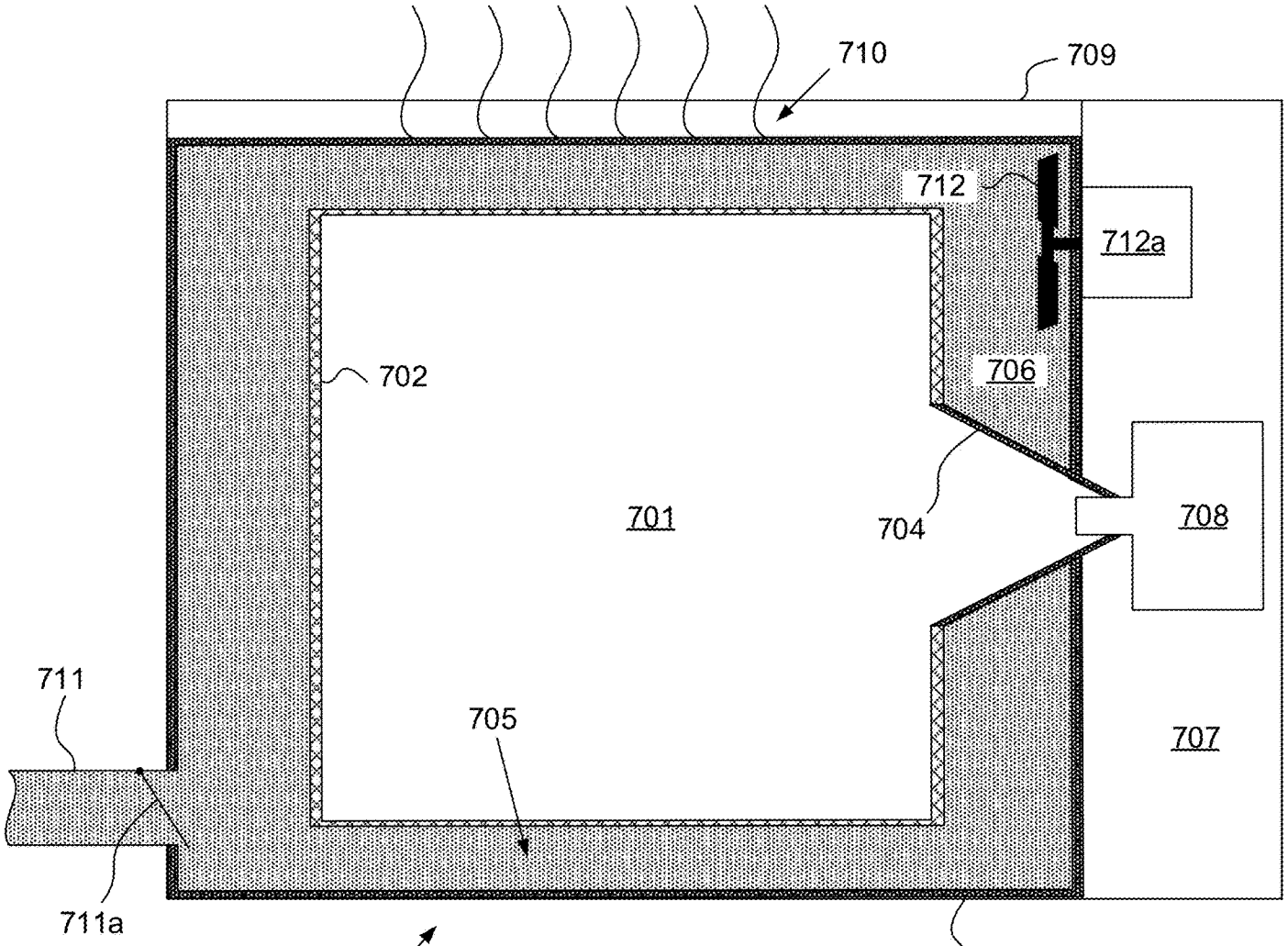
FIG. 7 is a section view of another embodiment of a zero-resonance microwave, including selected components.

FIG. 7 is a section view of another embodiment of a zero-resonance microwave, including selected components. Microwave oven 700 includes cooking cavity 701, microwave-transparent walls 702, microwave-opaque housing 703, waveguide 704, reservoir 705, dielectric material 706, electronics compartment 707, magnetron 708, secondary housing 709, cooling vents 710, fluid inlet 711, and stirrer 712.

Similar to that described above regarding FIG. 6, in various embodiments, the microwave oven includes a secondary housing surrounding the microwave-opaque housing and/or the electronics compartment. The secondary housing is formed of any of a variety of materials, including hardened plastics, steel, aluminum, and/or other metal alloys. In some embodiments, the secondary housing is rigid and sturdy enough to provide structural support for one or more electrical components, a microwave door, the microwave-opaque housing, and/or the microwave-transparent walls.

FIG. 7 depicts another of many ways to cool the dielectric material. The cooling vents allow fluidic dielectric material to evaporate, and the fluid inlet introduces more fluid. In some embodiments, the fluid is reintroduced after evaporation and condensation, similar to the cooling coil arrangement. In other embodiments, fluid is supplied from a source separate from the microwave oven, such as via building plumbing and/or a fluid tank that stores fluid for the microwave. As shown, the fluid inlet includes one-way valve 711*a*. At an equilibrium stage, the fluid on the reservoir side of the valve is at the same pressure as the fluid on the opposite side of the valve. As the fluid is heated by attenuating microwaves, it begins to evaporate, reducing the amount of fluid in the reservoir. The resulting decreased pressure in the reservoir creates a pressure gradient across the valve, which allows fluid to pass from the inlet to the reservoir. Additionally, an initial increase in pressure occurs in the reservoir before evaporation occurs, in some embodiments. However, because the valve is one-way, this increase in pressure does not result in backflow.

While evaporation and introduction of new fluid is, in some embodiments, sufficient to cause circulation of the dielectric material in the reservoir, in some embodiments, a stirrer is disposed in the reservoir to aid in circulation and/or to stimulate evaporation. In the depicted embodiment, the stirrer is powered by motor 712*a*, which is disposed in the electronics compartment and coupled to the microwave-opaque housing.

Figure 8:
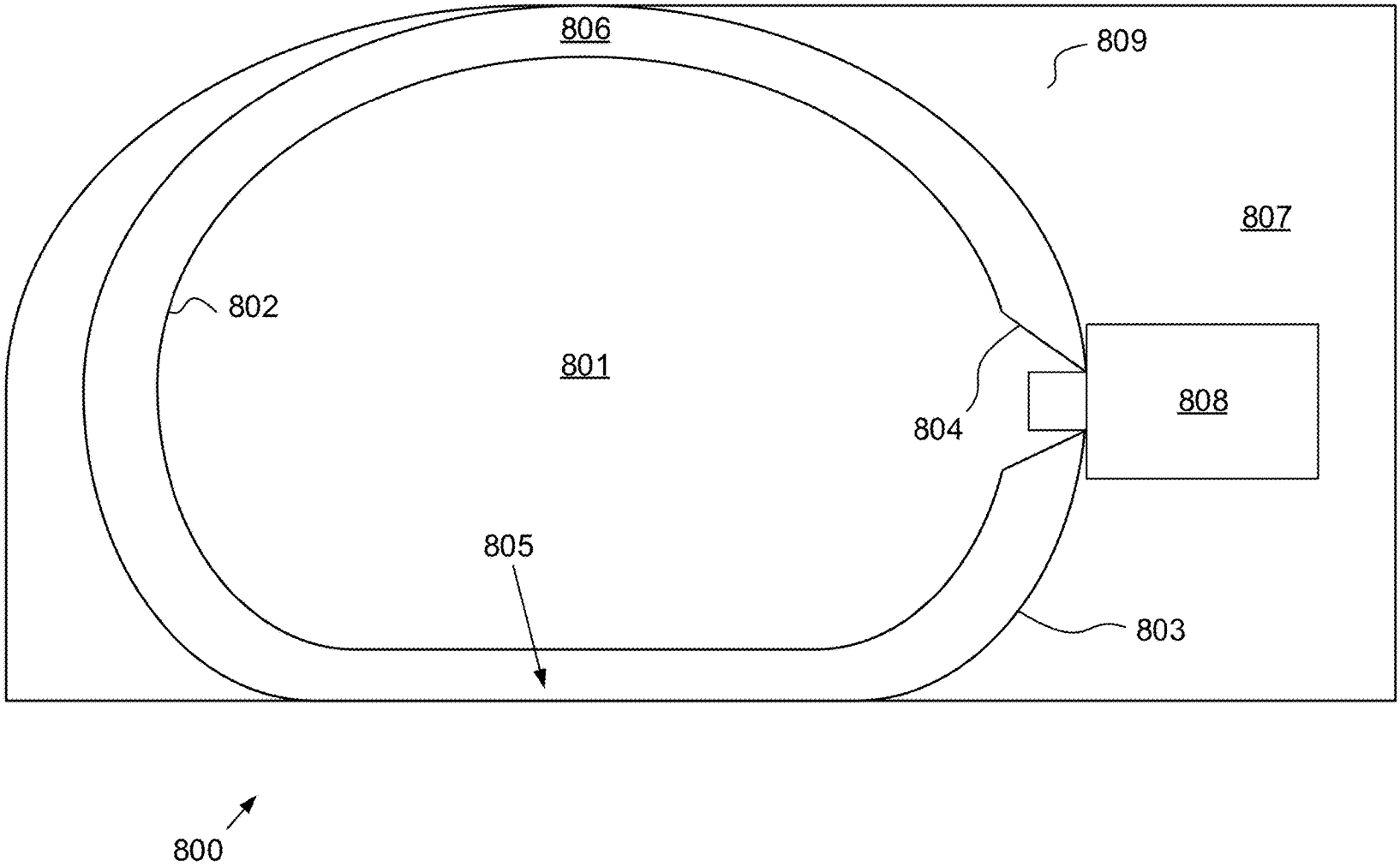
FIG. 8 is a section view of yet another embodiment of a zero-resonance microwave, including selected components.

FIG. 8 is a section view of yet another embodiment of a zero-resonance microwave, including selected components. Microwave oven 800 includes cooking cavity 801, microwave-transparent walls 802, microwave-opaque housing 803, waveguide 804, reservoir 805, dielectric material 806, electronics compartment 807, magnetron 808, and secondary housing 809. As shown, and similar to that described above, the cooking cavity, microwave-transparent walls, and microwave-opaque housing are cylindrical. Additionally, in the depicted embodiment, the reservoir is internally cooled. For example, the dielectric material includes a gel and a porous solid, such as an organic and/or silicon fiber mesh. The left side of the dielectric material heats faster than the right side, thus creating a temperature gradient that causes circulation of the dielectric gel through the fibrous mesh. The gel is cooled by the fibrous mesh at the right side of the cooking chamber, and recirculates back to the left side. In some such embodiments, a temperature sensor measures the temperature of the cool side of the dielectric material and, at an upper threshold temperature, prevents further operation of the microwave until the dielectric material reaches a lower threshold temperature. Such a feature is also incorporated into various other embodiments such as those described above with regard to other FIGs.

Figure 9:
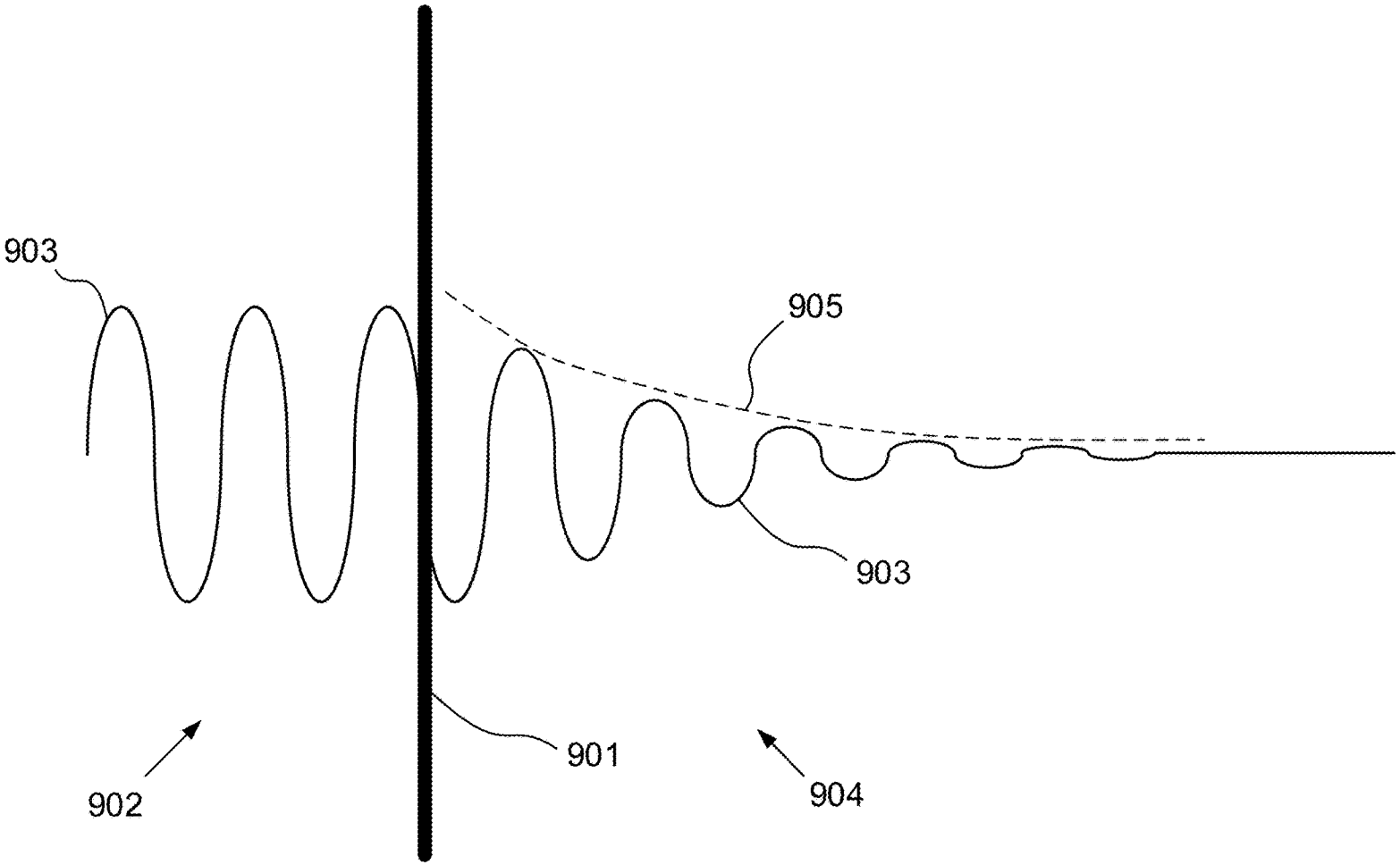
FIG. 9 depicts a microwave power attenuation profile of microwaves passing through a dielectric material.

FIG. 9 depicts a microwave power attenuation profile of microwaves passing through a dielectric material. Barrier 901 represents the surface of a dielectric material. At side 902 of barrier 901, which is outside the dielectric material (such as in one of the cooking cavities or microwave-transparent walls described above), microwaves 903 have a roughly constant power amplitude. While only a vacuum truly has zero power attenuation, for the purposes of this description, zero power attenuation is deemed to be less than or equal to 20% power attenuation for a given length. At side 904, which is inside the dielectric material, the microwaves have a diminishing power amplitude. Slope 905, which is depicted as exponential, but is also, for various materials, linear, corresponds to the length of dielectric material the microwaves must pass through to be sufficiently attenuated that a cooking cavity is deemed a "zero-resonance" cooking cavity. While 100% attenuation is desirable, greater than or equal to 80% attenuation is deemed sufficient.

Figure 10A:
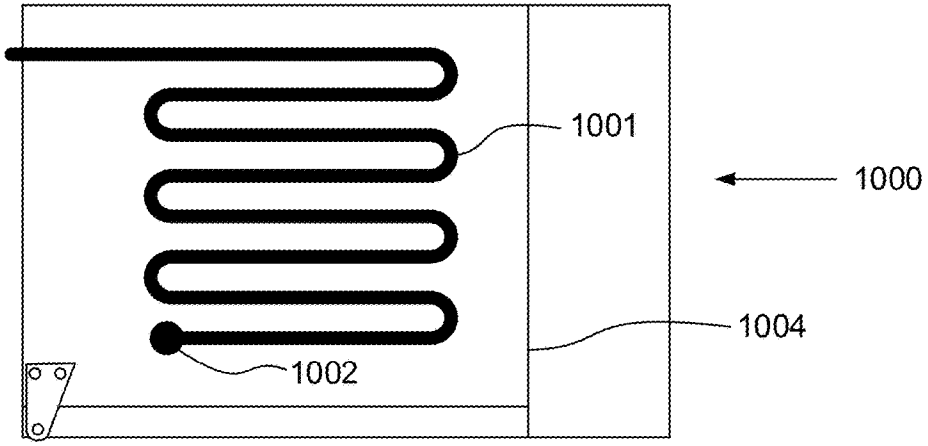
FIGS. 10A-C depict views of cooling systems for use with a zero-resonance microwave oven.
Figure 10B:
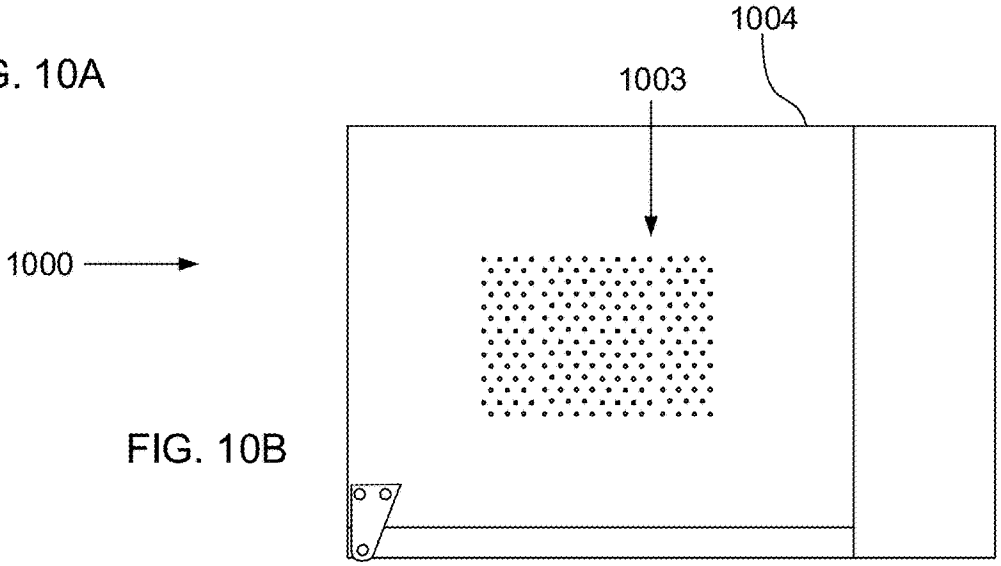
Figure 10C:
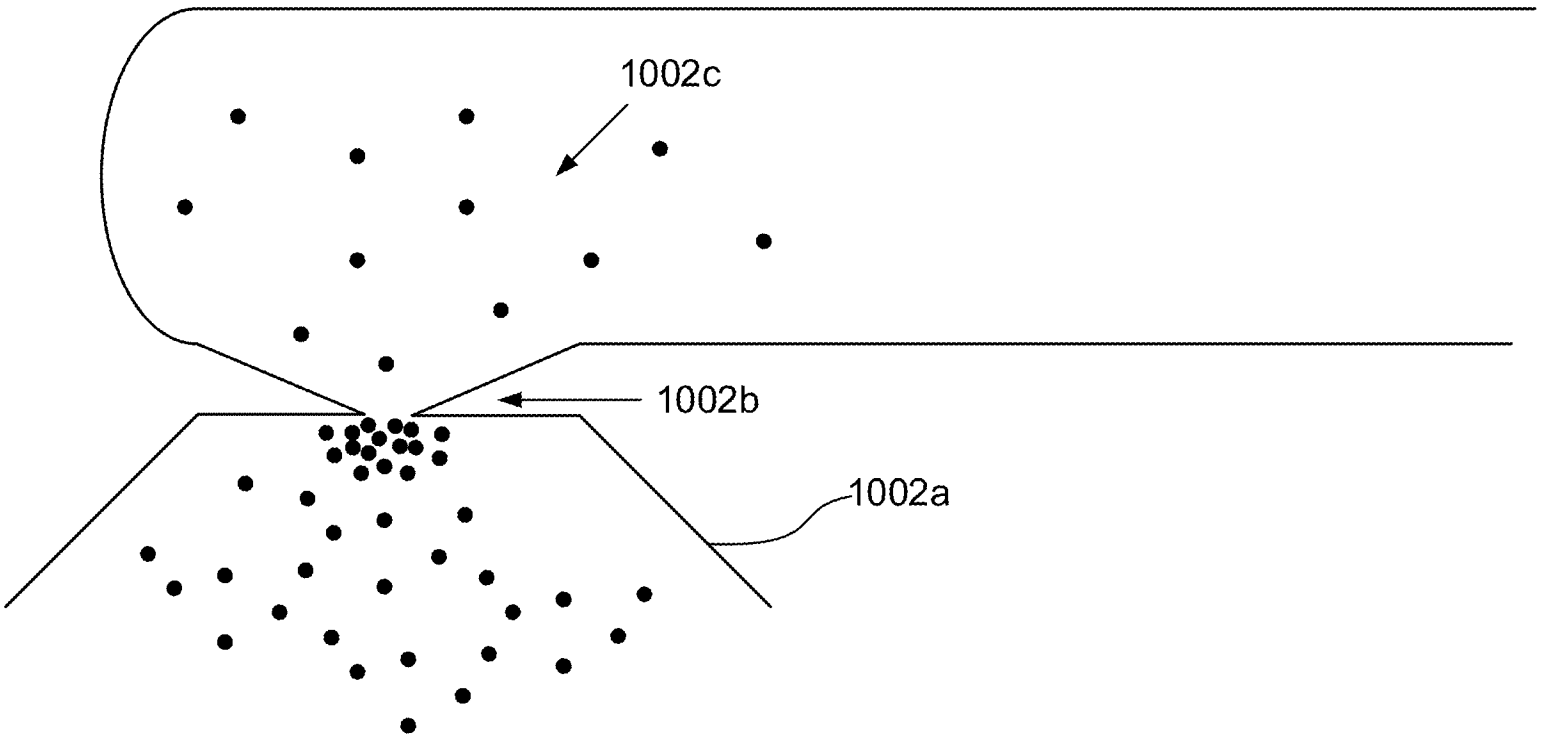

FIGS. 10A-C depict views of cooling systems for use with a zero-resonance microwave oven. As shown in FIG. 10A, in some embodiments, a cooling coil system is used. In some such embodiments, zero-resonance microwave oven 1000 includes cooling coils 1001 and constrictor valve 1002. The cooling coils wrap back and forth across the microwave, creating a high-surface area zone for heat transfer from a fluid within the coils to air outside the microwave. FIG. 10B depicts the microwave oven with cooling vents 1003. In some embodiments, including some that use water as a dielectric, the cooling vents allow evaporated dielectric fluid to pass from the reservoir. In some embodiments, housing 1004 is constructed of a material sufficient to support items that can be steam-cooked.

FIG. 10C is a blown-up section view of constrictor valve 1002. The constrictor valve includes tapered nozzle 1002*a*, choke point 1002*b*, and release zone 1002*c*. As the rate of fluid evaporation in the reservoir increases, gas molecules are forced by the nozzle towards the choke point. The molecules build up at the choke point, causing an increase in pressure in the reservoir. As the molecules pass through the choke point, they experience a significant drop in pressure in the release zone. The drop in pressure for a relatively similar volume results in an immediate drop in temperature of the gas. As the gas moves through the cooling coil, it is cooled further, eventually converting back to liquid form. The corresponding drop in pressure creates a pressure gradient across the cooling coil, which draws liquid and gas through the cooling coil.

Figure 11:
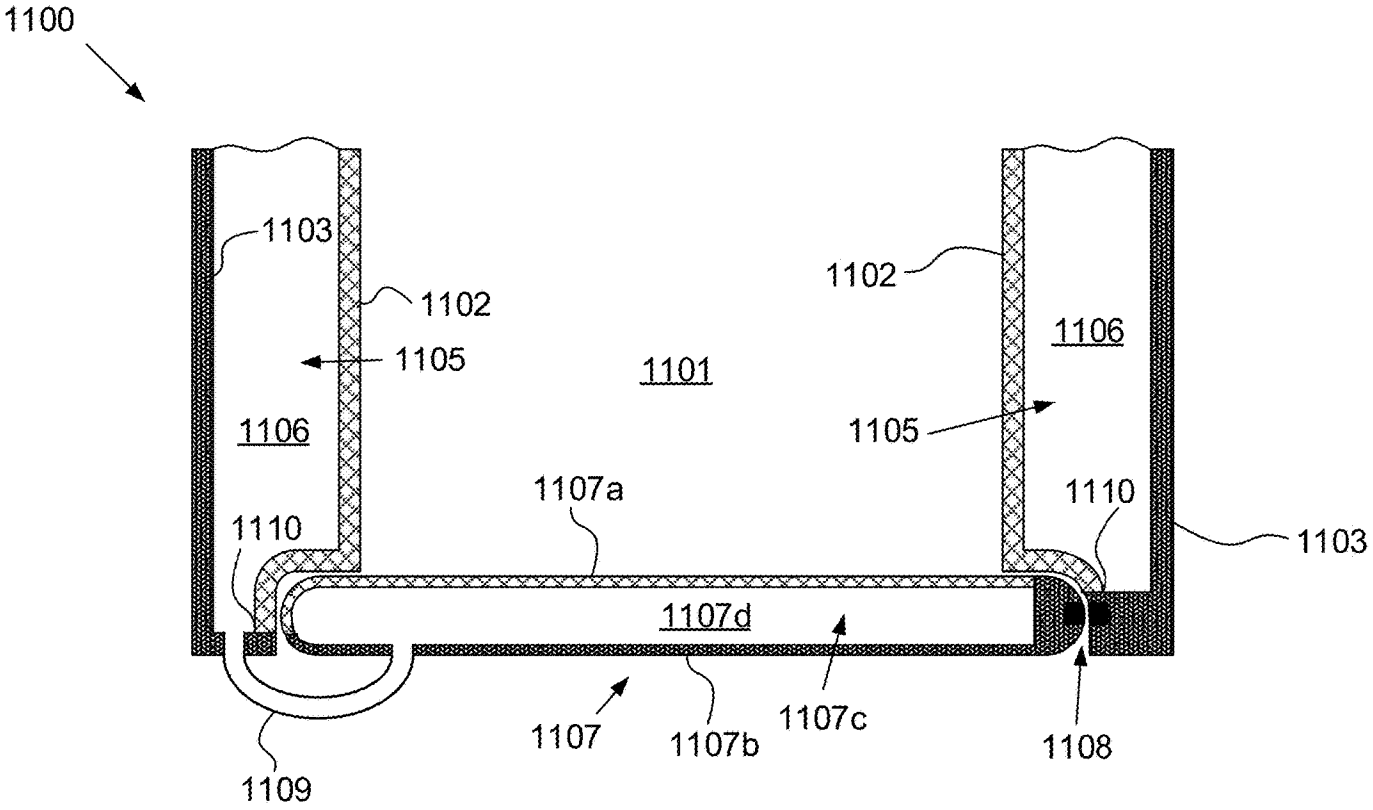
FIG. 11 depicts a partial section view of a zero-resonance microwave oven, including selected components.

FIG. 11 depicts a partial section view of a zero-resonance microwave oven, including selected components. Microwave oven 1100 includes cooking cavity 1101, microwave-transparent walls 1102, microwave-opaque housing 1103, reservoir 1105, dielectric material 1106, door 1107, magnets 1108, and reservoir coupling hose 1109.

The cooking cavity, microwave-transparent walls, microwave-opaque housing, reservoir, and dielectric material are similar to those described above with regard to other FIGs. Similarly, the door, which includes microwave-opaque inner wall 1107*a*, microwave-opaque outer wall 1107*b*, second reservoir 1107*c*, and second dielectric material 1107*d*, is similar to that described above regarding other FIGs. The door is held closed by the magnets, which include, in various embodiments, permanent magnets, ferromagnets, and/or electromagnets.

The main reservoir and the second reservoir are coupled by the reservoir coupling hose. This allows fluid transfer between the two reservoirs. The coupling hose is, in various embodiments, made of a flexible material, such as corrugated plastic, rubber, or combinations thereof. While, in some embodiments, the dielectric materials are the same, in other embodiments, the dielectric materials are different. For example, in some embodiments, one dielectric material is denser than the other, one has a higher dielectric constant than the other, and/or one has a higher thermal coefficient than the other. In some such embodiments, such disparities result in fluid flow that moves hotter fluid to cooler zones.

As shown in the depicted embodiment, in various embodiments, the microwave-transparent walls and the microwave-opaque housing form intersections 1110. At such intersections, in some embodiments, the microwave-opaque housing provides structural support to the microwave-transparent walls. This also, in various embodiments, allows for thermal transfer between the walls and the housing, cooling the walls. In some embodiments, at the intersections, the walls are bonded to the housing. For example, in some embodiments, the walls are bonded to the housing using a thermoset adhesive. In some embodiments, either the wall or the housing wraps partly around the other in a super-heated state and, as the walls and housing cool, the outer material compresses around the inner material. For example, some such embodiments include steel housing ends wrapped around glass wall ends. In some embodiments, to prevent separation at the intersections, temperature sensors are included and temperature thresholds set that prevent operation of the microwave when the steel reaches a maximum temperature at which it would begin pulling away from the glass.

We claim:

1. A zero-resonance microwave oven, comprising:
- a cooking cavity;
- an opening that allows access to the cavity;
- a plurality of microwave-transparent walls surrounding the cavity;
- a microwave-opaque housing surrounding the plurality of microwave-transparent walls; and
- a reservoir surrounding the cavity, the reservoir filled with a dielectric material and disposed between the plurality of microwave-transparent walls and the microwave-opaque housing, the reservoir having a depth greater than or equal to half the penetration depth of microwaves in the dielectric material and less than or equal to twice the penetration depth of microwaves in the dielectric material.

2. The microwave oven of claim 1, wherein the dielectric material comprises water, ester, betaine, glycerol, methanol, propylene glycol, ethanol, or combinations thereof.

3. The microwave oven of claim 2, wherein the water comprises deionized water, heavy water, or combinations thereof.

4. The microwave oven of claim 1, wherein the cavity is cylindrical, polyhedral, hexahedral, or combinations thereof.

5. The microwave oven of claim 1, wherein at least one of the microwave-transparent walls and the opening, or the microwave-opaque housing form a shape comprising a cylinder, a polyhedron, a hexahedron, or combinations thereof.

6. The microwave oven of claim 1, further comprising one or more intersections whereat the microwave-transparent walls merge with the microwave-opaque housing.

7. The microwave oven of claim 1, further comprising a door disposed over the opening.

8. The microwave oven of claim 7, wherein the door comprises a microwave-transparent inner wall facing the cavity and a microwave-opaque outer wall.

9. The microwave oven of claim 8, further comprising a second reservoir covering the opening, the second reservoir filled with a second dielectric material and disposed between the microwave-transparent inner wall and the microwave-opaque outer wall of the door, the second reservoir having a depth greater than or equal to half the penetration depth of microwaves in the second dielectric material and less than or equal to twice the penetration depth of microwaves in the second dielectric material.

10. The microwave oven of claim 9, further comprising a passage between the second reservoir and the reservoir that is disposed between the one or more microwave-transparent walls and the microwave-opaque housing.

11. The microwave oven of claim 9, wherein the dielectric material comprises water, ester, betaine, glycerol, methanol, propylene glycol, ethanol, or combinations thereof.

12. The microwave oven of claim 11, wherein the water comprises deionized water, heavy water, or combinations thereof.

13. The microwave oven of claim 1, further comprising a cooling coil disposed outside the microwave-opaque housing and coupled to the reservoir.

14. The microwave oven of claim 13, the cooling coil further comprising a constrictor valve and a liquid reintroduction valve, each coupled to the reservoir.

15. The microwave oven of claim 13, wherein at least a portion of the cooling coil is disposed above the reservoir.

16. The microwave oven of claim 1, further comprising one or more steam vents disposed above the reservoir.

17. The microwave oven of claim 1, further comprising a fluid supply hose coupled to the reservoir, wherein the dielectric material is a fluid.

18. The microwave oven of claim 17, further comprising a check valve directly coupling the fluid supply hose to the reservoir.

19. The microwave oven of claim 17, wherein the pressure of fluid in the fluid supply hose is equal to the counter-pressure of fluid in the reservoir, and wherein, as fluid in the reservoir evaporates, the counter-pressure decreases, allowing fluid to flow from the fluid supply hose into the reservoir.

20. The microwave oven of claim 1, wherein the dielectric material is a fluid, and wherein the microwave oven further comprises a fluid stirrer disposed within the reservoir that stirs the dielectric fluid.

* * * * *